US005931344A

United States Patent [19]

Montague-Smith

[11] Patent Number: 5,931,344

[45] Date of Patent: Aug. 3, 1999

[54] WALL MOUNTABLE PRODUCT DISPENSER

[76] Inventor: Peter Montague-Smith, La Arboloda, Calle Avlle, 17, 11310 Sotogrande, Cadiz, Spain

[21] Appl. No.: 09/046,340

[22] Filed: Mar. 23, 1998

Related U.S. Application Data

[63] Continuation-in-part of application No. 08/324,696, Oct. 18, 1994, abandoned.

[51] Int. Cl.[6] ..... B65D 35/28

[52] U.S. Cl. ..... 222/100

[58] Field of Search ..... 222/93, 96, 100, 222/106, 105, 95

[56] References Cited

U.S. PATENT DOCUMENTS

| | | | |
|---|---|---|---|
| 2,042,098 | 5/1936 | Hitzler | 222/100 |
| 2,087,712 | 7/1937 | White | 222/100 |
| 2,718,984 | 9/1955 | Messer | 222/100 |
| 2,760,681 | 8/1956 | Arquelles et al. | 222/100 X |
| 2,775,370 | 12/1956 | Tripoli | 222/100 |
| 2,822,111 | 2/1958 | Tripoli | 222/100 |
| 3,065,881 | 11/1962 | Harrison, Jr. | 222/100 |
| 3,204,824 | 9/1965 | McGraw, Jr. | 222/100 |
| 3,917,118 | 11/1975 | Odgen | 222/100 |
| 4,220,260 | 9/1980 | Webster | 222/100 |
| 5,203,473 | 4/1993 | Willey | 222/100 X |

*Primary Examiner*—Kevin P. Shaver
*Attorney, Agent, or Firm*—Miller, Sisson, Chapman & Nash, P.C.

[57] ABSTRACT

A dispenser for paste products contained in compressible packages. A nozzle retaining member is attachable about the threaded neck of the package after the neck is extended through a hole in the base of the dispenser. The nozzle retaining member further engages two hooks on the external surface of the dispenser to hold the package in a properly aligned position.

1 Claim, 2 Drawing Sheets

WALL MOUNTABLE PRODUCT DISPENSER

This is a continuation-in-part application based on U.S. patent application Ser. No. 08/324,696 filed Oct. 18, 1994, entitled "Wall Mounted Toothpaste Dispenser", now abandoned.

BACKGROUND OF THE INVENTION

1. Field of the Invention

The invention relates to a dispenser for attachment to a wall or other vertical surface; and, more particularly, to a dispenser for dispensing paste products such as toothpaste, gel, shaving or hand creams from a thin, plastic, biodegradable bag. Further, the invention may be utilized with a range of sizes of currently existing standard collapsible tubes by attachment of a special screw-on-cap.

2. Description of the Prior Art

Dispensers of the prior art are numerous and varied, but all have been designed for use with tubes which have a certain rigidity when filled. Most require outflow adapters to be fitted to the threaded nozzle of the tube within the dispenser. The bag of the present invention containing product has no rigidity when filled and, therefore, requires a special nozzle retaining device which may be easily fitted prior to attaching the nozzle cap to the threaded nozzle. This establishes the present invention as new with regard to prior art, but as it is also capable for use with a range of sizes of standard product tubes in current use.

Most of the prior art paste dispensers employ internally threaded adapters of a predetermined size and thread to screw onto the threaded nozzle of a tube after it has been passed through the body of the dispenser housing. Few have attempted to address or successfully resolve the problem of tubes presenting nozzles of different lengths, diameters, and threads. These size variations have caused annoyance to many purchasers and severely limited their market potential as tube nozzles of different manufacturers vary considerably in both size and thread.

The following prior art devices embody adapters to fit only onto tubes of predetermined size or thread:

a. Hitzler, U.S. Pat. No. 2,042,098, which relies on a slot of predetermined size, to receive the neck of a tube;

b. Messer, U.S. Pat. No. 2,718,984, relies on a circular locknut of predetermined size and thread to fit the threaded neck of the tube;

c. Arquelles, et al, U.S. Pat. No. 2,760,681, presents an internally threaded sleeve of predetermined size and thread to fit the screw threaded end of the tube;

d. Tripoli, U.S. Pat. No. 2,775,370, embodies a disc of predetermined size and thread;

e. Ogden, U.S. Pat. No. 3,917,118, appears to require a head (not shown) and an orifice prepared to receive a nozzle of predetermined size and thread;

f. Willey, U.S. Pat. No. 5,203,473, relies on an internally threaded adapter boss to fit only predetermined threaded nozzles;

g. Hughes, British Pat. No. 600,859; Secling, British Pat. No. 820,200; and Bromage, British Pat. No. 1,202,703, all rely on adapters to fit nozzles of only one size and thread;

h. Tripoli, U.S. Pat. No. 2,822,111, seeks to address the problem of varying sized nozzles and threads by presenting an adapter which screws into the internal diameter of the tube nozzle. This reduces the outflow aperture by more than fifty percent;

i. White, U.S. Pat. No. 2,087,712, attempts to resolve the problem of different threaded nozzles by providing a dispensing head of relatively hard metal with an internal thread tapering inwardly and downwardly. However, it is necessary to twist the tube into the head, effective cutting a suitable thread. This solution is theoretically possible in the White design as the tube was not totally enclosed, but was visible and accessible to be held and even turned. The practicality of type of head member is dubious as it seems that upon turning the tube to effect firm engagement of the threaded nozzle in the dispensing head, the closed end of the tube is not in correct alignment to be inserted into the slot of the winder key. Further, it is not possible to use such a head member in a dispenser which completely encloses the paste-containing tube.

It will, therefore, be appreciated that there remains a need for an improved dispenser of material from compressible tubes which is simple and inexpensive to produce, easy to use, and widens market acceptability by being capable of use with all known tubes containing toothpaste. The present invention meets these criteria as well as that for the purpose of which it has been specifically designed.

SUMMARY OF THE INVENTION

In view of the disadvantages present in the various designs of paste dispensers of the prior art; and, in particular, the serious disadvantage of none of them being capable of being used with all known leading brands of toothpaste, the object of the present invention is to provide a dispenser capable of containing tubes of varying dimension with nozzles of differing sizes (lengths and diameters) and threads as currently found on tubes of different brands of paste products. Further, the present invention is capable of expressing paste, gel, or cream from a form of compressible package or bag. The package, when filled, is of a suitable physical size having threaded nozzle provided at the outflow end. The dispenser is, for example, capable of dispensing paste, gel or cream from a compressible package or bag, much larger than tubes currently in use.

To achieve the foregoing objectives and overcome the disadvantages present in the prior art, the present invention provides a main body of one-piece, molded, rigid plastic construction, the first side wall of which provides an integral guide to receive and firmly hold the end boss of a one-piece, molded, plastic winder key. The opposing wall is slotted to receive and guide the winder key, which is formed with a lot to receive the flattened end of the paste tube or other form of package or bag. A hole is provided in the base of the housing through which the threaded nozzle of the tube is passed. A nozzle retaining device is fitted externally on the tube, thereby securing the tube relative to the base of the housing. A flexible, plastic washer, to prevent backflow of material, is provided to place over the tube nozzle prior to fitting the one-piece, molded, plastic, multi-fit screw-on-cap, which is capable of being fitted to tube nozzles of differing size and thread. Rotation of the winder key held within the opposing guides of the side walls of the housing effectively expels the paste from the tube.

It will be appreciated that when the present invention is used to expel the contents from the bag-like package previously described, the package is provided with a threaded nozzle and a suitable cap, perhaps rendering the flexible plastic washer and the multi-fit screw-on-cap unnecessary.

The present invention rests not in any one of the foregoing features but in the combination of all of them disclosed and claimed, thus distinguishing it from the prior art and the disadvantages found therein.

The foregoing is a broad outline of the most important elements of the invention. An object of the present invention is to provide an apparatus for the dispensing of paste or cream material from a new form of package much larger than tubes in current use, concealed within the dispenser, and eliminating the necessity for attractive packaging manufactured from strong, but thin, biodegradable material appealing to the popular environmental conscience.

A further object of the present invention is to provide an apparatus capable of dispensing paste or cream material from standard tubes in current use which present nozzles of both different size and thread.

Another object of the present invention is to provide a dispensing apparatus which has some of the advantages of prior art dispensers but overcomes the disadvantages which have thus far seriously limited their market potential and acceptability.

Yet another object of the present invention is to provide a new and improved toothpaste dispenser which is simple and inexpensive to manufacture, thereby making the finished produce economically available to the purchasing public.

DETAILED DESCRIPTION OF THE PREFERRED EMBODIMENT

Figure 1:
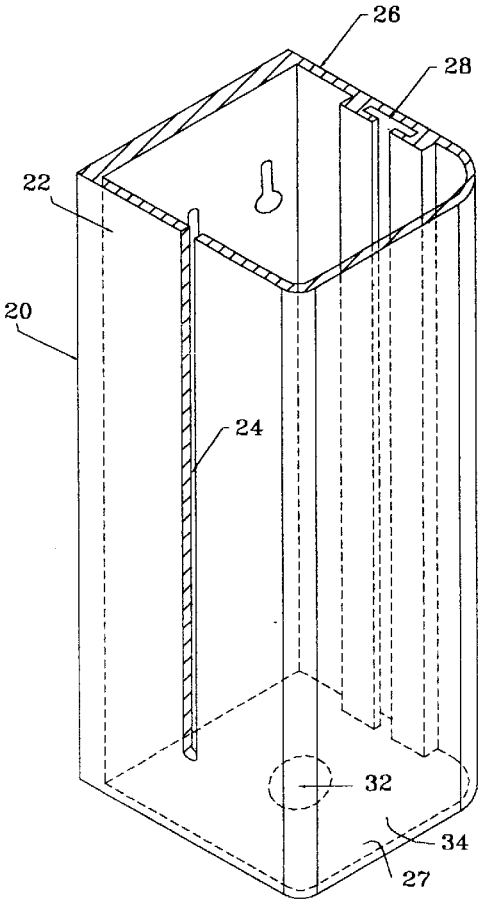
FIG. 1 is a perspective view of the one-piece molded, plastic main body of the dispenser, with the top removed.
Figure 2:
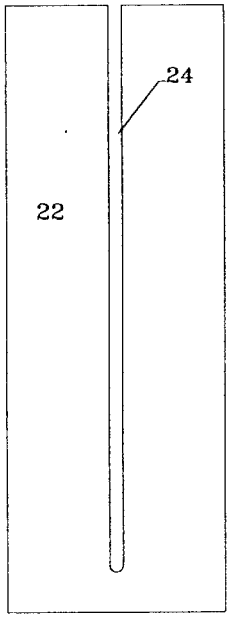
FIG. 2 shows the left side elevation view of the dispenser with a slot cut out to accept insertion of the winder key.
Figure 3:
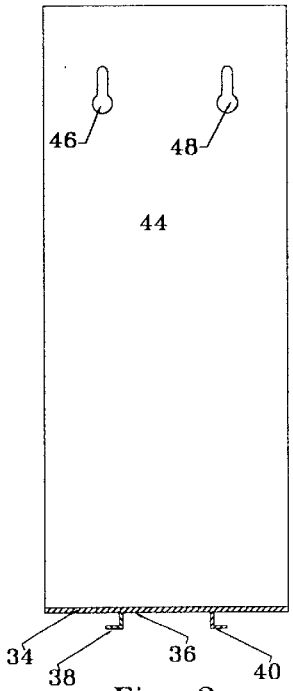
FIG. 3 shows a back elevation view of the body of the dispenser, cut out to allow for attachment to walls with a sectional view of the base of the dispenser with the integral hooks to hold the nozzle retaining device.

With reference to the drawings, FIGS. 1 to 15, a new and improved paste dispenser is disclosed. FIG. 1 illustrates a main body (20) of one-piece molded, rigid, plastic with one side wall (22) cut out to provide a slot (24) and an opposing parallel side wall (26) provided with a guide (28) of predetermined size. FIG. 2 shows the extension of slot (24) along wall (22). Guide (28) is an integral part of the molded main body (20) and is intended to securely retain the winder key (30). A front wall (27) is also shown formed into the main body (20). A hole (32) of predetermined size is positioned centrally in the base (34) of the main body (20) to allow for the clear passage of the threaded nozzle of the paste package but of a size small enough to retain the tapered neck of the package. In FIG. 3, it may be seen that the external surface (36) base (34) of the main body (20) is provided with integral hooks (38 and 40) to securely hold the tube nozzle retaining device (42).

The rear wall (44) of the main body (20) is provided with cut outs (46 and 48) to allow for screw fixing to a convenient wall or vertical surface. The main body (20) of the dispenser (10) is completed by the fitting of the removable top (50) which may or may not be provided with openings (52) for toothbrushes and the like.

Figure 4:
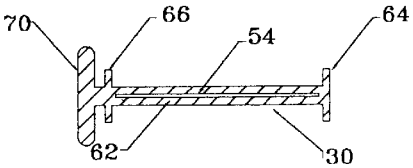
FIG. 4 is a detail of the one-piece molded plastic winder key of the present invention.

FIG. 4 shows a winder key (30) which is slidably positioned within the main body (20) and provided with a slot (54) to receive the closed end (56) of the paste tube or bag (60), the rotation of the key winds the package (60) onto the axle (62) of the winder key (30) to effect the dispensing of the contents of the package (60). A circular boss (64) is provided at one end of the winder key (30) to locate within the guide (28) of the main body (20) and a second circular boss (66) is provided at predetermined spacing from circular boss (64) to achieve touch contact of boss (66) with the internal surface (68) of the slotted side (22) of the main body (20). A circular knob is positioned externally of the main body (20) at predetermined spacing from boss (66) substantially equal to the thickness of slotted side (22) to facilitate manual rotation of the winder key (30).

Figure 5:
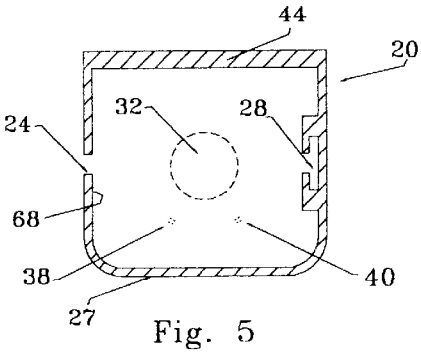
FIG. 5 is a top sectional view of the body of the dispenser.
Figure 6:
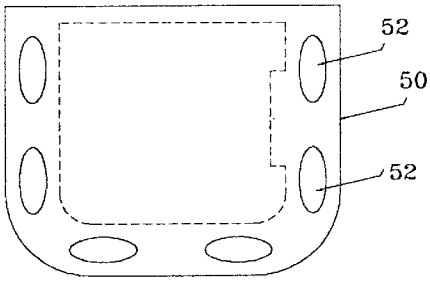
FIG. 6 shows a top plan view of the removable dispenser top with openings for toothbrushes.
Figure 7:
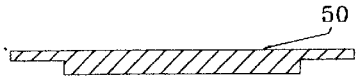
FIG. 7 is a side, cross-sectional view of the removable top of the dispenser.
Figure 8:
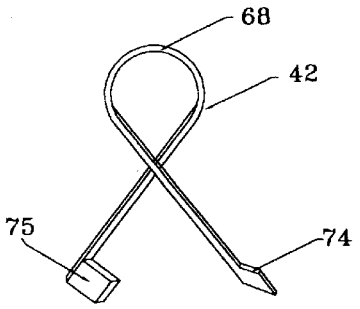
FIG. 8 shows a perspective view of the threaded nozzle retaining device of the present invention.
Figure 9:
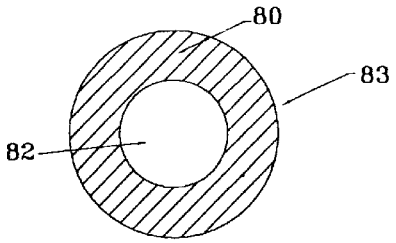
FIG. 9 shows the flexible plastic washer of the present invention.
Figure 10:
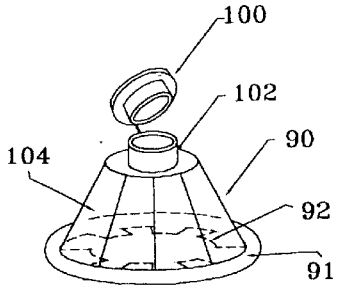
FIG. 10 is a perspective view of the one-piece, molded, plastic, multi-fit screw-on-cap of the present invention.
Figure 11:
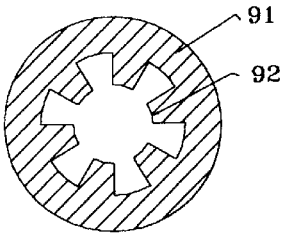
FIG. 11 is a plan view of the element of the cap with the tongues which enable it to fit a variety of tube nozzles.
Figure 12:
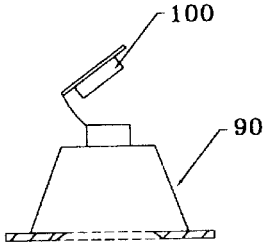
FIG. 12 is a side view of the screw-on-cap with flip-off lid.
Figure 13:
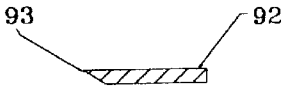
FIG. 13 shows a side, cross-sectional view of one tongue element in detail to larger scale.
Figure 14:
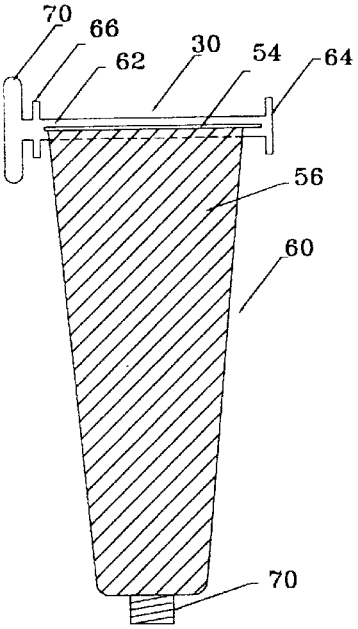
FIG. 14 shows a side elevation view of a paste tube inserted into the winder slot.
Figure 15:
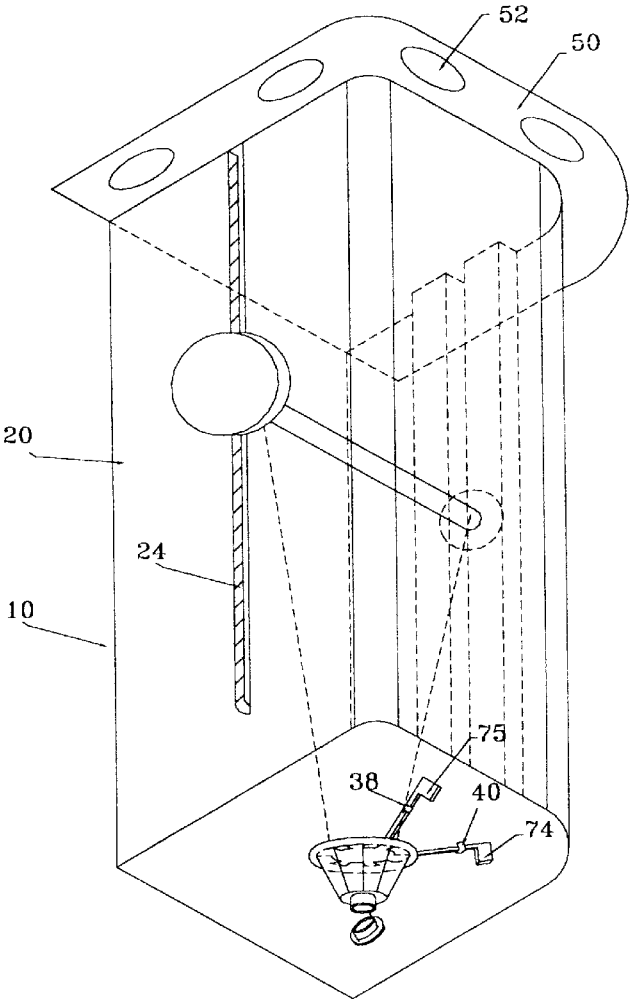
FIG. 15 shows the tube inserted within the dispenser housing, the multi-fit cap screwed on, the visible arms of the nozzle retaining device, and the removable top in position.

FIG. 5 is a top view of the main body (20) showing the relation of the slot (24), guide (28) and central opening (32). Turning to FIG. 8, illustrates a semi-rigid teflon nozzle retaining device (42) with a looped, rounded section (68) larger than the external diameter of threaded nozzles (70) of the paste tube or package (60). Retainer (42) is provided to be placed over the threaded nozzle of the tube (60) after the nozzle has been directed through the hole (32) in the base (34) of the main body (20). The tube (60) is thereafter secured within the main body (20) by fitting the left arm (74) of the retaining device (42) over the left integral hook (40) and applying outward pressure to the remaining arm (75) of the device in order to secure it over the remaining integral hook (38) on the external surface (36) of the base (34) of the main body (20). This method effectively closes the rounded section (68) of the device (42) around the threaded nozzle (70) of the tube (60), retaining the tube (60) relative to the base (34) of the dispenser (10).

A flexible plastic washer (80) with a central circular cut out (82) barely larger than the diameter of known tube nozzles (shown in FIG. 9) is provided to place over the tube nozzle (70) prior to the fitting of the multi-fit screw-on-cap (90) having inwardly depending tongues (92) to enable attachment to a variety of nozzles of differing sizes and threads. Washer (80) has an outer diameter greater than the diameter of hole (32).

Cap (90) (shown in FIGS. 10–12) has a flap type closure member (100) attached to nozzle (102). Tapering side walls (104) of cap (90) extend to an adaptor flange (91). Flange (91) is provided with the inwardly extending tongues (92) of semi-rigid plastic composition. The tongues are designed to open and flex to accommodate varying diameters of threaded nozzles and, at the same time, to securely engage the threads to retain the cap (90) on the package (60).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A dispenser for a paste products contained in a compressible package, said package having a closed end and a threaded nozzle end comprising:

a removable top;

a one-piece, molded, plastic main body, said body having a base having a centrally positioned circular opening and opposing hooks on an external surface; a front wall; a rear wall; first and second parallel side walls spaced apart a predetermined distance, said first side wall having a guide positioned medially and extending longitudinally from a top of said first side wall to said base of said main body, said second side wall having a slot positioned medially and extending longitudinally from a top of said second side wall to a predetermined distance above said base of said main body;

a winder key slidably receivable within said guide and said slot, said key having first and second spaced apart guide bosses, said first boss rotatably slidable within said guide and said second boss rotatably slidable along an inner surface of said second side wall, said key having centrally slotted axle to receive said closed end of said package;

a knob positioned externally of said second side wall for manual rotation of said winder key, said knob spaced apart from said second boss the approximate thickness of said second wall;

a nozzle retaining member for securing said packages within said main body, said retaining member releasable attachable to said threaded nozzle and said opposing hooks on said external surface of said base, said threaded nozzle end of said package extending through said central circular opening in said base;

a flexible plastic washer releasably secured to said nozzle and having a central orifice for passage of said threaded nozzle therethrough, said washer having an outer diameter greater than said central circular opening in said base; and a one-piece, molded plastic cap releasably threadable over said threaded nozzle end of said package, said cap having semi-rigid tongues extending inwardly for engagement with said threaded nozzle end of said package.

* * * * *